US008349530B2

(12) United States Patent
Kobayashi et al.

(10) Patent No.: US 8,349,530 B2
(45) Date of Patent: Jan. 8, 2013

(54) MAGNETIC POLYMER PARTICLE FOR DEVELOPING MAGNETIC LATENT IMAGE, METHOD OF PRODUCING THE SAME, LIQUID DEVELOPER FOR MAGNETIC LATENT IMAGE, CARTRIDGE, AND IMAGE FORMING DEVICE

(75) Inventors: Takako Kobayashi, Kanagawa (JP); Yoshihiro Inaba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1133 days.

(21) Appl. No.: 12/244,240

(22) Filed: Oct. 2, 2008

(65) Prior Publication Data

US 2009/0236558 A1 Sep. 24, 2009

(30) Foreign Application Priority Data

Mar. 21, 2008 (JP) ..... 2008-074192

(51) Int. Cl.
*G03G 15/08* (2006.01)

(52) U.S. Cl. ..... 430/114; 430/112; 430/113; 430/115; 430/137.22

(58) Field of Classification Search ..... 430/106.1, 430/108.23, 108.24, 112–115, 137.22
See application file for complete search history.

(56) References Cited

U.S. PATENT DOCUMENTS

| | | | | |
|---|---|---|---|---|
| 5,364,720 | A | 11/1994 | Nakazawa et al. | |
| 5,508,139 | A * | 4/1996 | Tanaka et al. | 430/108.23 |
| 6,391,507 | B1 * | 5/2002 | Macholdt et al. | 430/108.24 |
| 2003/0039908 | A1 * | 2/2003 | Hiratsuka et al. | 430/106.1 |
| 2003/0091918 | A1 * | 5/2003 | Uchinokura et al. | 430/106.1 |
| 2005/0069800 | A1 | 3/2005 | Coppenrath et al. | |
| 2007/0072102 | A1 * | 3/2007 | Dojo et al. | 430/106.1 |

FOREIGN PATENT DOCUMENTS

| | | |
|---|---|---|
| JP | 5-188827 | 7/1993 |
| JP | 5-87834 | 12/1993 |
| JP | 6-282098 | 10/1994 |
| JP | 9-134033 | 5/1997 |
| JP | 10-087711 | 4/1998 |
| JP | 10-247037 | 9/1998 |
| JP | 2001-134012 | 5/2001 |
| JP | 2004-099844 | 4/2004 |
| JP | 2004-325758 | 11/2004 |
| JP | 2005-107528 | 4/2005 |

* cited by examiner

*Primary Examiner* — Mark F Huff
*Assistant Examiner* — Rashid Alam
(74) *Attorney, Agent, or Firm* — Fildes & Outland, P.C.

(57) ABSTRACT

A magnetic polymer particle develops a magnetic latent image. The magnetic polymer particle includes a magnetic component, a polymer, and a colorant. The magnetic component is a magnetic particle containing iron having a number average particle diameter of from about 0.2 μm to about 1.2 μm. The magnetic particle is contained in one magnetic polymer particle in an amount of from 1 to 10 particles. The number average particle diameter of the magnetic polymer particle is from about 2.0 μm to about 7.0 μm.

10 Claims, 2 Drawing Sheets

MAGNETIC POLYMER PARTICLE FOR DEVELOPING MAGNETIC LATENT IMAGE, METHOD OF PRODUCING THE SAME, LIQUID DEVELOPER FOR MAGNETIC LATENT IMAGE, CARTRIDGE, AND IMAGE FORMING DEVICE

CROSS-REFERENCE TO RELATED APPLICATIONS

This application is based on and claims priority under 35 USC 119 from Japanese Patent Application No. 2008-074192 filed on Mar. 21, 2008.

BACKGROUND

1. Technical Field

The present invention relates to a magnetic polymer particle for developing a magnetic latent image, a method of producing the same, a liquid developer for a magnetic latent image, a cartridge, and an image forming device.

2. Related Art

A magnetic printing device capable of printing a required number of copies when a latent image is formed once is known. The magnetic printing device holds a magnetic latent image magnetically formed on a magnetic recording medium (magnetic latent image carrying member), supplies a magnetic toner to the magnetic recording medium in a developing area to develop the magnetic latent image as a toner image, presses a recording medium, such as paper, against the magnetic recording medium in a transfer area to transfer the developed toner image to the recording medium, and conveys the recording medium after transferring to a fixing area for fixing to thereby complete printing. This system is generally referred to as magnetography.

In the above system, the magnetization state in the magnetic recording medium is semipermanently maintained. Therefore, when a latent image is formed once, an extremely large number of copies can be obtained simply by repeating a development and transferring process. Moreover, since it is not necessary to re-record a latent image for obtaining multiple copies, the printing speed can be increased. Furthermore, magnetism is stable against environmental changes (especially temperature changes) as compared with static electricity, and moreover a high-resolution image can be obtained.

In contrast, since a magnetic latent image can be easily formed and deleted magnetically and a printing plate is unnecessary, the cost can be reduced.

As a specific process of the magnetography, for example, a magnetic toner is supplied to a magnetic recording medium by a separately-located supply roller. The supply roller holds a magnetic toner layer on the peripheral surface thereof, brings the magnetic toner layer into contact with a magnetic recording medium, and supplies the magnetic toner to the magnetic latent image of the magnetic recording medium for developing. As an image forming device using the above-mentioned process, there is a so-called dry-type image forming device utilizing a magnetic toner in the form of a powder.

SUMMARY

According to an aspect of the present invention, there is provided a magnetic polymer particle for developing a magnetic latent image, including a magnetic component, a polymer, and a colorant, the magnetic component being a magnetic particle containing iron having a number average particle diameter of from about 0.2 μm to about 1.2 μm and the magnetic particle being contained in one magnetic polymer particle in an amount of from 1 to 10 particles, and the number average particle diameter of the magnetic polymer particle being from about 2.0 μm to about 7.0 μm.

BRIEF DESCRIPTION OF THE DRAWINGS

Exemplary embodiment of the present invention will be described in detail based on the following figures, wherein.

DETAILED DESCRIPTION

Figure 1:
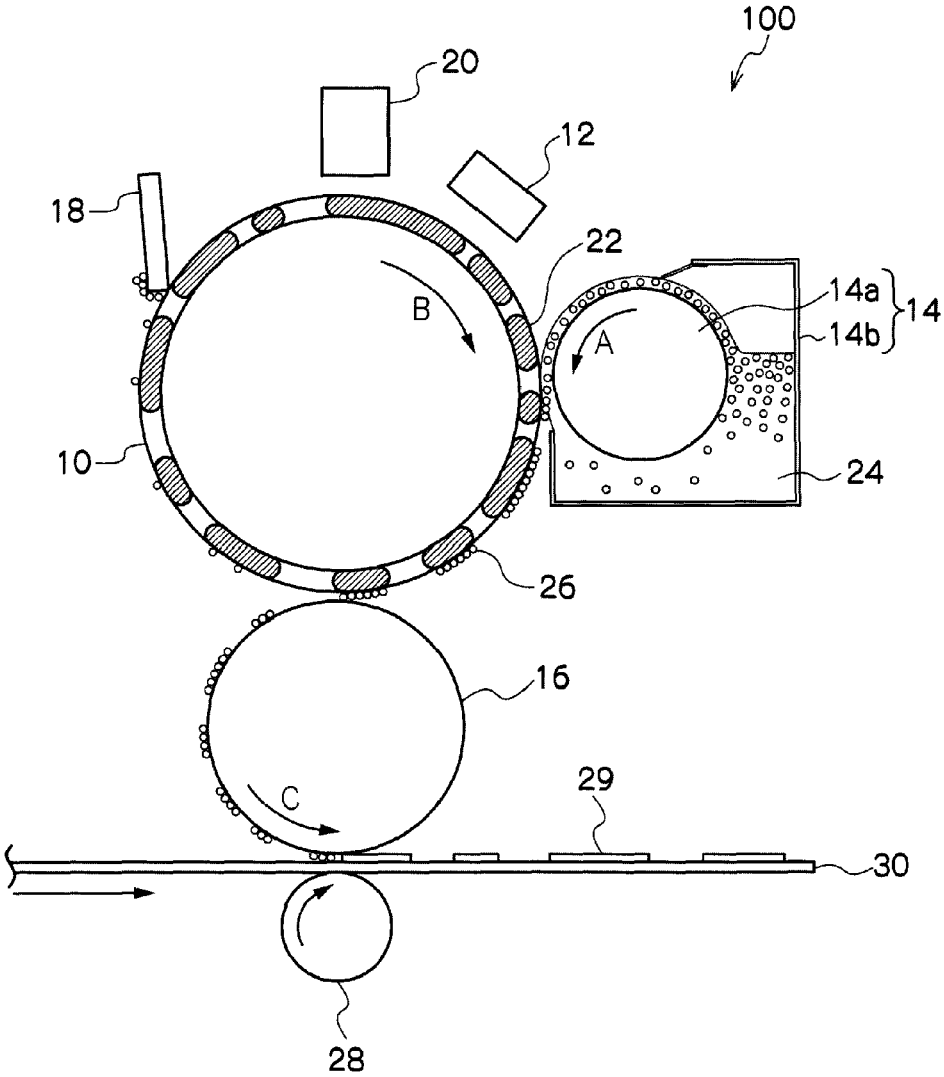
FIG. 1 is an outline block diagram illustrating an example of an image forming device.

Hereinafter, the present invention will be described in more detail by way of exemplary embodiments.

<Magnetic Polymer Particle for Developing a Magnetic Latent Image and Production Method Thereof>

A magnetic polymer particle for developing a magnetic latent image according to an exemplary embodiment of the present invention (hereinafter sometimes simply referred to as a "magnetic polymer particle") is structured as a magnetic polymer particle containing a magnetic component, a polymer, and a colorant, in which the magnetic component is a magnetic particle containing iron having a number average particle diameter of from about 0.2 μm to about 1.2 μm (or 0.2 μm to 1.2 μm) and the magnetic particle is contained in one magnetic polymer particle in an amount of from 1 to 10 particles; and the number average particle diameter of the magnetic polymer particle is from about 2.0 μm to about 7.0 μm (or 2.0 μm to 7.0 μm).

It should be noted that the above-described magnetic polymer particle is a particle in which a magnetic component has been dispersed in the polymer.

More specifically, as a magnetic component, a magnetic particle containing iron is used, and each magnetic polymer particle to contain from 1 to 10 magnetic particles having a number average particle diameter of from about 0.2 μm to about 1.2 μm (or 0.2 μm to 1.2 μm).

The number average particle diameter of the magnetic particle is preferably adjusted to from 0.2 μm to 1.0 μm, and more preferably from 0.5 μm to 0.8 μm. Moreover, the number of the magnetic particles contained in one magnetic polymer particle is preferably from 1 to 6, and more preferably from 1 to 4.

It should be noted that the magnetic particle(s) in the magnetic polymer particle can be confirmed, without cutting the magnetic polymer particle, by observing a reflection electron image under a scanning electron microscope (SEM). The details of the observation method will be described later. With respect to 5 to 10 magnetic polymer particles, the number of the magnetic particles contained in each magnetic polymer particle is measured, and the average value is used as "the number of the magnetic particles in one magnetic polymer particle". Furthermore, the magnetic polymer particles are dissolved, and only the magnetic component is separated. Then, the maximum diameter of each magnetic particle is measured by the SEM observation, and the average value is used as "the number average particle diameter of magnetic particles".

In such a case, the number average particle diameter of the magnetic polymer particles each containing the magnetic particle(s) is from about 2.0 μm to about 7.0 μm. Also for the magnetic polymer particles, the maximum diameter of the particles is measured, and the average value is used.

The number average particle diameter of the magnetic polymer particles is preferably from 2.0 μm to 6.0 μm, and more preferably from 2.5 μm to 5.5 μm.

It should be noted that the above-mentioned number average particle diameter of the magnetic polymer particles is a value obtained by taking a photograph of dry particles with an optical microscope or an electron microscope, measuring the particle diameter of each of 100 to 200 particles randomly selected therefrom, and dividing the sum of the particle diameters by the number of the particles. The same applies to the following.

Furthermore, in the magnetic polymer particle of this exemplary embodiment, the content of the magnetic component may be from about 2% by weight to about 10% by weight (or 2% by weight to 10% by weight).

By adjusting the content of the magnetic component to from about 2% by weight to about 10% by weight (or 2% by weight to 10% by weight) relative to the polymer particles, the magnetic domains in the magnetic polymer particles are likely to become uniform, and the influence on the color tone of the magnetic component is further reduced.

The content of the magnetic component in the magnetic polymer particles has a considerable influence on not only the saturation magnetization of the particles but also the color thereof. Therefore, by adjusting the content of the magnetic component to the above-mentioned range, fading of the color tone may be prevented while maintaining the magnetism of the particles in the case where a colorant which is described later is contained. Moreover, the image quality may be increased by adjusting the number average particle diameter of the magnetic polymer particle to the above-mentioned range. Thus, when the above-described conditions are satisfied, the number of the magnetic particles may be reduced, whereby a color image with a higher image quality may be formed.

The content of the magnetic component is more preferably from 1.0% by weight to 15.0% by weight.

It should be noted that the content of the magnetic component can be measured as a proportion (%) by subjecting produced magnetic polymer particles to thermogravimetric analysis (TGA) from room temperature (20° C.) up to 600° C., measuring the weight loss, and dividing the weight obtained by subtracting the weight loss amount from the initial weight of a sample to be measured, by the initial weight of the sample to be measured.

Hereinafter, the structure of the magnetic polymer particle of this exemplary embodiment will be described together with a method of producing the same.

The magnetic polymer particle of this exemplary embodiment contains a magnetic component, a polymer, and a colorant. Specifically, the magnetic polymer particle contains, for example, a polymer as a binding resin, the above-mentioned specific magnetic particle, a colorant required for color images, and other required components. As mentioned later, the magnetic polymer particle is a magnetic polymer particle in the form of a particle that can be used for a developer for liquid magnetography. Therefore, it is preferable to render the magnetic polymer particle dispersible (uniformly) in an aqueous medium, such as water, while suppressing the variation and maintaining the magnetism at a certain degree or higher.

(Magnetic Component)

The magnetic component in this exemplary embodiment is a magnetic particle containing iron having a number average particle diameter in a specific range. More specifically, the magnetic component in this exemplary embodiment is an iron powder containing an iron material, such as pure iron or carbonyl iron.

Examples of a method of producing the iron powder containing iron as a constituent include the following 5 methods:

(1) Method of producing a mill scale reduced iron powder: Mill scale generated upon rolling a steel material is reduced with coke;

(2) Method of producing an ore reduced iron powder: The same treatment as above is performed using iron ore as a raw material;

(3) Method of producing an iron powder by spraying: Molten iron is made to flow out from a fine pore, and formed into particles using high-pressure water and high-pressure gas;

(4) Method of electrolytically producing an iron powder: Iron is electrolytically deposited from an aqueous solution of iron salt such as iron sulfate or ferric chloride; and (5) Method of producing a carbonyl iron powder: Water vapor is added to carbonyl iron ($Fe(CO)_5$) to be thermally decomposed and pulverized.

Among the above, the carbonyl iron powder refers to the iron powder obtained by the method (5).

In this exemplary embodiment, the surface of the magnetic particle(s) may be subjected to hydrophobizing treatment. There is no limitation on the hydrophobizing treatment method, and the hydrophobizing treatment can be carried out by coating the surface of the magnetic powder with a hydrophobizing agent, such as various coupling agents, silicone oil, or resin. Among the above, it is preferable to coat the surface with a coupling agent.

Examples of the coupling agent include a silane coupling agent and a titanium coupling agent. The silane coupling agent is more preferably used, and a silane compound having a structure represented by General Formula (1) is still more preferable.

RmSiYn General Formula (1):

In General Formula (1), R represents an alkoxy group, m represents an integer of 1 to 3, Y represents a hydrocarbon group, such as an alkyl group, a vinyl group, a glycidoxy group, or a methacrylic group, and n represents an integer of 1 to 3.

Specific examples thereof include vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyl trimethoxysilane, phenyltrimethoxysilane, phenethyltrimethoxysilane, n-hexadecyl trimethoxysilane, and n-octadecyltrimethoxysilane.

The hydrophobizing treatment of the magnetic powder may be performed using an alkyltrialkoxysilane coupling agent represented by $C_pH_{2p+1}$—Si—$(OC_qH_{2q+1})_3$, wherein p represents an integer of 2 to 20 and q represents an integer of 1 to 3, or an aralkyl trialkoxysilane coupling agent represented by $C_6H_5$—$C_rH_{2r}$—Si—$(OC_sH_{2s+1})_3$, wherein r represents an integer of 2 to 20 and s represents an integer of 1 to 3. It should be noted that the term "aralkyl" as used herein refers to a hydrocarbon group having both an aromatic structure and an aliphatic structure. More specifically, a substituted or non-substituted aryl group is substituted in place of the hydrogen atom of an alkyl group. Examples of the aralkyl group include a benzyl group, a phenethyl group, and an α-mesityl group.

When p and r in each formula are in the above-mentioned ranges, a desired hydrophobicity may be given to the magnetic powder while avoiding agglomeration of the magnetic powder, which may make it possible to uniformly disperse the magnetic powder in the polymer particles. Moreover, when q and s are in the above-mentioned ranges, the reactivity of a silane coupling agent may be favorable, which may make it possible to perform a desired hydrophobizing treatment.

Among the above, the use of the alkyltrialkoxysilane coupling agent represented by $C_pH_{2p+1}$—Si—$(OC_qH_{2q+}1)_3$ is preferable so as to achieve an excellent dispersibility in a polymerizable monomer.

In the case of, for example, treatment with a silane coupling agent, the hydrophobizing treatment of the magnetic particle(s) can be performed by generally known methods, such as a dry processing which involves reacting an evaporated silane coupling agent with a magnetic particle(s) which has/have been formed into a cloud shape by stirring; a wet process which involves dispersing a magnetic particle(s) in a solvent, and adding dropwise a silane coupling agent for reaction; or a method which involves dispersing a magnetic particle(s) in a solvent, mixing with a silane coupling agent, evaporating the solvent with a distillation apparatus, such as a rotary evaporator, and heating the magnetic particle(s) to which the silane coupling agent has been adhered. Moreover, the above-described hydrophobizing treatments may also be used in combination.

The amount of the hydrophobizing agent relative to the magnetic powder in the hydrophobizing treatment is preferably adjusted to the range of from 0.05 parts by weight to 20 parts by weight, and more preferably from 0.1 parts by weight to 10 parts by weight based on 100 parts by weight of the magnetic particles.

The content of the magnetic particle(s) in each magnetic polymer particle is determined in accordance with a desired magnetism. In this exemplary embodiment, the content of the magnetic particle(s) in each magnetic polymer particle may be adjusted to the range of from 1.0% by weight to 15.0% by weight based on the total amount of constituents of each magnetic polymer particle, and a preferable range is as described above.

(Polymer)

Examples of the polymer include homopolymers or copolymers, such as: styrenes, such as styrene and chlorostyrene; monoolefins, such as ethylene, propylene, butylene, and isoprene; vinyl esters, such as vinyl acetate, vinyl propionate, vinyl benzoate, and vinyl acetate; α-methylene aliphatic monocarboxylic acid esters, such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers, such as vinyl methyl ether, vinyl ethyl ether, and vinylbutyl ether; and vinyl ketones, such as vinyl methyl ketone, vinyl hexyl ketone, and vinyl isopropenyl ketone.

Among the above, preferable examples of the polymers include polystyrene, a styrene-alkylacrylate copolymer, a styrene-alkylmethacrylate copolymer, a styrene-acrylonitrile copolymer, a styrene-butadiene copolymer, a styrene-maleic anhydride copolymer, polyethylene, and polypropylene. Furthermore, examples thereof include polyester, polyurethane, epoxy resin, silicone resin, polyamide modified rosin, paraffin, and waxes.

In this exemplary embodiment, a particularly preferably used constituent polymer is a polymer in which at least one of (meth)acrylate monomers and styrene monomers has been polymerized. Hereinafter, such a polymer will be described in detail.

It should be noted that, here, the (meth)acrylate refers to "acrylate" or "methacrylate"; the "(meth)acrylate" refers to "(meth)acrylic acid ester" as commonly used; and the styrene monomers refer to styrene and styrene derivatives. The same applies to the following description.

In the (meth)acrylate monomer, the alkyl group of the alcohol residue of the (meth)acrylate ester may be a substituted or non-substituted alkyl group having 1 to 18 carbon atoms Examples of the alkyl group include a methyl group, an ethyl group, an n-propyl group, an isopropyl group, an n-butyl group, a t-butyl group, a pentyl group, an isopentyl group, a neopentyl group, a hexyl group, a heptyl group, an n-octyl group, a nonyl group, a decyl group, an undecyl group, and a dodecyl group. In addition to the above, the alkyl group may be a substituted alkyl group such as a benzyl group, a hydroxyethyl group, a hydroxyethyl group in which the hydroxy substituent is protected with a hydrophobic protective group, such as dihydropyrane; or a polyoxyethylene group. In view of the dispersibility of the polymer particles in water, it is possible to use, as the polymer, a polymer containing hydroxyethyl methacrylate as a polymerization component or to further modify the (meth)acrylate polymer with (poly)ethylene glycol.

The styrene monomer may be a vinyl group-containing monomer having a substituted or non-substituted aryl group having from 6 to 12 carbon atoms. Examples of the aryl group include a phenyl group, a naphthyl group, a tolyl group, and a p-n-octyloxyphenyl group, and the phenyl group is preferable.

Examples of a substituent in the alkyl group of the (meth) acrylate monomer and the aryl group of the styrene monomer include an alkyl group, an alkoxy group, a halogen atom, and an aryl group.

As the alkyl group, the substances mentioned above as examples of the alkyl group can be similarly mentioned. Examples of the alkoxy group include a methoxy group, an ethoxy group, a propoxy group, and a butoxy group. Among the above, the methoxy group and the ethoxy group are preferable. Examples of the halogen atom include a fluorine atom, a chlorine atom, a bromine atom, and an iodine atom, and the fluorine atom and the chlorine atom are preferable. As the aryl group, the substances mentioned above as examples of the aryl group can be similarly mentioned.

When both the (meth)acrylate monomer and the styrene monomer are used as monomers, the ratio of the content of the (meth)acrylate to the styrene monomer in a mixture is preferably from 95/5 to 5/95, and more preferably from 90/10 to 10/90 in a molar ratio ((meth)acrylate monomer/styrene monomer).

Moreover, to the magnetic polymer particle of this exemplary embodiment, another monomer may be further copolymerized in addition to the polymer component of the above-mentioned monomer.

As the polymer in this exemplary embodiment, a monomer having crosslinking properties (cross linking agent) may be further copolymerized if required. Specific examples of the polymer include crosslinked polymers crosslinked with a cross linking agent such as divinylbenzene, ethylene glycol di(meth)acrylate, diethylene glycol di(meth)acrylate, glycidyl(meth)acrylate, and 2-([1'-methylpropylideneamino] carboxyamino)ethyl(meth)acrylate. A crosslinking structure may be formed during polymerization, or crosslinking may be effected after polymer particles are formed by polymerization.

The content of the cross linking agent in a monomer mixture is preferably from 0.05 parts by weight to 20 parts by weight, and more preferably from 0.05 parts by weight to 10 parts by weight based on 100 parts by weight of the total amount of the (meth)acrylate monomer and the styrene monomer.

To the magnetic polymer particles of this exemplary embodiment, another resin component can be further blended.

Examples of the resin component include a non-crosslinked polymer, such as a plastic binding resin. Specific examples thereof include homopolymers or copolymers of styrenes (styrene resin), such as styrene, para-chlorostyrene, and α-methyl styrene; homopolymers or copolymers of alkyl (meth)acrylates having a vinyl group (vinyl resin), such as methyl(meth)acrylate, ethyl(meth)acrylate, n-propyl(meth) acrylate, n-butyl(meth)acrylate, lauryl(meth)acrylate, 2-ethylhexyl(meth)acrylate, and lauryl(meth)acrylate; homopolymers or copolymers of vinylnitriles (vinyl resin), such as acrylonitrile and methacrylonitrile; homopolymers or copolymers of vinyl ethers (vinyl resin), such as vinyl methyl ether and vinyl isobutyl ether; homopolymers or copolymers of vinyl ketones (vinyl resin), such as vinyl methyl ketone, vinyl ethyl ketone, and vinyl isopropenyl ketone; homopolymers or copolymers of olefins (olefin resin), such as ethylene, propylene, butadiene, and isoprene; non-vinyl condensed resins, such as an epoxy resin, a polyester resin, a polyurethane resin, a polyamide resin, a cellulosic resin, and a polyether resin; and graft polymers of these non-vinyl condensed resins and vinyl monomers. These resins may be used singly or in a combination of two or more. Among these resins, the styrene resin, the vinyl resin, the polyester resin, and the olefin resin are preferable. A copolymer of styrene and n-butyl(meth) acrylate, a copolymer of n-butyl(meth)acrylate and a bisphenol-A fumarate, and a copolymer of styrene and olefin are particularly preferable.

When the polymer in this exemplary embodiment contains a non-crosslinked polymer, the molecular weight (number average molecular weight) of the non-crosslinked polymer is preferably from 5,000 to 1,000,000, and more preferably from 10,000 to 500,000.

It should be noted that the number average molecular weight is measured for a component separated as a dissolved part using THF which is described later, by using gel permeation chromatography (GPC). Measurement is performed using HLC-8120GPC and SC-8020 (manufactured by TOSOH CORPORATION) as the GPC, 2 columns (TSKgel SuperHM-H, manufactured by TOSOH CORPORATION, 6.0 mm ID×15 cm) as a column, and THF (tetrahydrofuran) as an eluate.

(Colorant)

Examples of the colorant include carbon black, such as furnace black, channel black, acetylene black, and thermal black; inorganic pigments, such as colcothar, Prussian blue, and titanium oxide; azo pigments, such as fast yellow, disazo yellow, pyrazolone red, chelate red, brilliant carmine, and para brown; phthalocyanine pigments, such as copper phthalocyanine and metal-free phthalocyanine; and condensed polycyclic pigments, such as flavanthrone yellow, dibromoanthrone orange, perylene red, quinacridone red, and dioxazine violet.

Since the magnetic polymer particles of this exemplary embodiment can be used for color display as described above, pigments for coloring, such as magenta, yellow, and cyan, may be used.

More specific examples include various pigments, such as Chrome yellow, Hansa yellow, Benzidine yellow, Threne yellow, Quinoline yellow, Permanent orange GTR, Pyralozone orange, Vulcan orange, Watch young red, Permanent red, Dupont oil red, Lithol Red, Rhodamine B lake, Lake red C, Rose bengal, Aniline blue, Ultramarine blue, Calco oil blue, Methylene blue chloride, Phthalocyanine blue, Phthalocyanine Green, Malachite green oxalate, C.I. pigment•red 48:1, C.I. pigment•red 122, C.I. pigment•red 57:1, C.I. pigment•red 238, C.I. pigment•yellow 12, C.I. pigment•yellow 97, C.I. pigment•yellow 17, C.I. pigment•yellow 180, C.I. pigment•yellow 74, C.I. pigment•yellow 93, C.I. pigment•blue 15:1, and C.I. pigment•blue 15:3. These pigments can be used singly or in a combination of two or more.

In the magnetic polymer particles of this exemplary embodiment, the content of the colorant may be from 1 part by weight to 30 parts by weight based on 100 parts by weight of polymer. It is also effective to use, as required, a colorant which has been subjected to surface treatment or a pigment dispersant. By selecting the colorant type, a yellow toner, a magenta toner, a cyan toner, etc., can be obtained.

Also in this case, the above-mentioned various kinds of magnetic particles are added in accordance with the color of a colorant. The ratio of the content by weight of the magnetic particles A to the content by weight of the colorant B (A/B) may be in the range of from 1.0/30 to 2.0/1.0.

If the content ratio of the magnetic particles to the colorant is less than 1.0/30, desired magnetic properties may not be achieved in some cases. When the content ratio exceeds 2.0/1.0, the brightness and the chromaticity of a display color may be poor, especially when used for color display.

(Other Components)

The magnetic polymer particles of this exemplary embodiment may contain an ingredient, such as a release agent, an inorganic powder, a lubricant, or an abrasive according to the purpose. Examples of the release agent used herein include low-molecular-weight polyolefines, such as polyethylene, polypropylene, and polybutene; silicones having a softening point under heating; fatty amides, such as oleic acid amide, erucic acid amide, recinoleic acid amide, and stearic acid amide; long-chain fatty alcohols, such as lauryl alcohol, stearyl alcohol, and behenyl alcohol; vegetable waxes, such as carnauba wax, rice wax, candelilla wax, Japan wax, and jojoba oil; animal waxes, such as yellow wax; mineral and petroleum waxes, such as montan wax, ozokerite, ceresin, paraffin wax, microcrystalline wax, and Fischer Tropsch wax; and modified substances thereof.

(Production of a Magnetic Polymer Particle for Developing a Magnetic Latent Image)

Next, a method of producing a magnetic polymer particle for developing a magnetic latent image of this exemplary embodiment will be described.

The method of producing a magnetic polymer particle for developing a magnetic latent image of this exemplary embodiment includes: granulating a magnetic polymer particle containing a magnetic component, a polymer, and a colorant; controlling the particle diameter of the magnetic polymer particle; and controlling the amount of a magnetic component in the particle in the magnetic polymer particle whose particle diameter has been controlled.

—Granulation Process—

Known methods can be utilized as the granulation process, and, for example, a suspension-polymerization method, an emulsion polymerization method, a dispersion polymerization method, and a seed polymerization method may be used. Furthermore, suspension polymerization can also be performed using the emulsification method known as a membrane emulsification method.

More specifically, when a magnetic polymer particle is produced by, for example, the suspension-polymerization method, a mixture is first prepared which contains a desired amount of the polymer-forming monomer, the above-mentioned specific magnetic particle as the magnetic component, the above-mentioned colorant, a cross linking agent, a polymerization initiator, etc.

As the cross linking agent, known cross linking agents can be suitably selected and used. Examples thereof include divinylbenzene, ethylene glycol di(meth)acrylate, diethylene glycol di(meth)acrylate, methylenebis(meth)acrylamide, glycidyl(meth)acrylate, and 2-([1'-methylpropylideneamino] carboxyamino)ethyl methacrylate. Among the above, divinylbenzene, ethylene glycol di(meth)acrylate, diethylene glycol di(meth)acrylate are more preferable, and divinylbenzene is more preferable. Examples of the polymerization initiator include an azo polymerization initiator and a peroxide initiator. An oil-soluble initiator is preferable.

As an exemplary method of producing a mixture containing respective monomers mentioned above, etc., the monomer, the polymerization initiator, and other required components are first mixed to produce a mixed solution. The mixing methods are not limited.

Subsequently, a specific magnetic particle as a magnetic component and a colorant are dispersed in the mixed solution. Known methods can be applied to the dispersion of the magnetic component and the like in the above-mentioned mixed solution. More specifically, a disperser, such as a ball mill, a sand mill, an attritor, or a roll mill, can be used. When a monomer component is separately polymerized beforehand, and a magnetic component and other component(s) are dispersed in the obtained polymer, a kneader such as a roll mill, a kneader, a Banbury mixer, or an extruder can be used.

The method of producing such a mixture is not limited to the above. For example, a magnetic component and the like may be blended using a mixture of the magnetic component and a colorant at the time of producing the mixed solution; or a monomer, a magnetic component, etc., may be mixed at once to produce such a mixture.

Next, the mixture containing the monomer and other component(s) is suspended in an aqueous medium. The suspension can be performed as follows, for example.

More specifically, the mixture is put in an aqueous medium in which a salt, such as an inorganic salt, is dissolved and a dispersion stabilizer is contained, and then suspended. For the suspension, known suspension methods may be used. Examples of such methods include mechanical suspension methods, such as a method in which a monomer and other component(s) are suspended in an aqueous medium by rotating a special stirring blade, such as a mixer, at a high speed; a method in which suspension is conducted utilizing a shear force generated by a rotor starter, which is known as a homogenizer; and a method in which suspension is conducted utilizing ultrasonic waves.

Examples of the dispersion stabilizer include anionic surfactants, such as a sulfate ester surfactant, a sulfonic acid salt surfactant, a phosphate ester surfactant, and a soap; cationic surfactants, such as an amine salt surfactant and a quarternary ammonium salt surfactant; nonionic surfactants, such as a polyethylene glycol surfactant, an alkylphenol ethylene oxide adduct surfactant, an alkyl alcohol ethylene oxide adduct surfactant, and a polyhydric alcohol surfactant; and various graft polymers. But, the dispersion stabilizer is not limited to the above.

Subsequently, the suspended monomer and particles containing a magnetic component are subjected to suspension polymerization to thereby obtain a magnetic polymer particle. The polymerization reaction can be performed not only under atmospheric pressure but also under increased pressure. These other reaction conditions are applied as required, and are not limited.

As the reaction conditions, the reaction may be performed, for example, under an atmospheric pressure at a reaction temperature of from 40° C. to 100° C. for from 1 to 24 hours while stirring the suspension in which the suspension particles have been dispersed, from the view point of obtaining polymer particles with a yield of about 80% or more.

When a magnetic polymer particle is produced by an emulsion polymerization method, a slight amount of unsaturated acid, such as acrylic acid, methacrylic acid, maleic acid, or styrene sulfonic acid, may be able to act as a protective colloid, which may make it possible to perform soap-free polymerization. Thus, the emulsion polymerization method is preferable.

Examples of a polymerization initiator used in this exemplary embodiment include an azo polymerization initiator and a peroxide initiator, and a water-soluble initiator is more preferable.

Examples of the water-soluble azo initiator include 2,2'-azobis[N-(2-hydroxyethyl)-2-methyl-propione amidine]dihydrochloride, 2,2'-azobis(2-amidinopropane)dihydrochloride, 2,2'-azobis[2-(2-imidazoline-2-yl)propane] dihydrochloride, 2,2'-azobis[2-(2-imidazoline 2-yl) propane], and 4,4'-azobis(4-cyanovaleric acid).

Examples of the water-soluble peroxide initiator include ammonium persulfate, potassium persulfate, and hydrogen peroxide.

The addition amount of the above-mentioned polymerization initiator is not limited, and is preferably from 0.05 parts by weight to 10 parts by weight, and more preferably from 0.1 part by weight to 5 parts by weight, based on 100 parts by weight of the total monomer components.

The number average particle diameter of the magnetic polymer particle thus obtained, whose particle diameter is not controlled, is preferably from 2.0 μm to 6.0 μm, and more preferably from 2.5 μm to 5.5 μm. When the number average particle diameter is in the above-mentioned range, the preparation of particles may be facilitated, ease of handling is achieved, and the magnetic particle may be effectively incorporated into the particles.

In this exemplary embodiment, it is preferable for the polymer to contain at least one member selected from a hydroxy group, a carboxy group, and an alkyl ester group thereof. Thus, the water dispersibility of the magnetic polymer particle may be sharply improved. A polymer can contain the above-mentioned functional group by selecting a monomer constituting the polymer.

The presence of each functional group mentioned above can be confirmed by measuring the infrared absorption spectrum of the magnetic polymer particles. However, there is an influence of the magnetic component or the like, and therefore it is preferable to determine the presence of the functional group by the following method.

More specifically, since the amounts of the hydroxyl group and the carboxyl group in the magnetic polymer particles vary with the magnetic component, it is preferable to identify the hydroxyl group and the carboxyl of a polymer as the amount of hydroxyl groups and the amount of carboxyl groups, respectively, of a polymer component excluding the magnetic component.

In this case, when the polymer has only a hydroxyl group, the amount of hydroxyl groups, may be from 0.1 mmol/g to 5.0 mmol/g. When the amount of hydroxyl groups is in the above-mentioned range, an excellent dispersibility in an aqueous medium may be achieved without polymer particles being swollen.

The amount of hydroxyl groups is preferably from 0.2 mmol/g to 4.0 mmol/g, and more preferably from 0.3 mmol/g to 3.0 mmol/g.

In contrast, when a polymer has a carboxyl group, the amount of carboxyl groups may be from 0.005 mmol/g to 0.5 mmol/g. When the amount of carboxyl groups is in the above-mentioned range, an excellent dispersibility in an aqueous medium and a swelling inhibitory effect may be achieved even if the number of functional groups is small as compared to the hydroxyl group. These properties may be maintained regardless of whether or not other functional groups exist.

The amount of carboxyl groups is preferably from 0.008 mmol/g to 0.3 mmol/g, and more preferably from 0.01 mmol/g to 0.1 mmol/g. In this case, when a hydroxyl group is also contained, the amount of hydroxyl groups is preferably from 0.2 mmol/g to 4.0 mmol/g, and more preferably from 0.3 mmol/g to 3.0 mmol/g.

With respect to the amount of hydroxyl groups and the amount of carboxyl groups, for example, the amount of hydroxyl groups can be determined by adding a fixed amount of reagent, such as a pyridine solution of acetic anhydride, to the above-mentioned polymer and heating; adding water for hydrolysis; separating the resultant into particles and a supernatant with a centrifugal separator; and titrating the supernatant with an ethanolic potassium hydroxide solution or the like using an indicator, such as phenolphthalein.

The amount of carboxyl groups can be determined by adding a reagent, such as an ethanolic solution of potassium hydroxide, to the polymer for neutralization; separating the resultant into particles and a supernatant with a centrifugal separator; and titrating the supernatant containing an excessive amount of potassium hydroxide with an isopropanol hydrochloric acid solution or the like using an automatic titrator.

When the carboxyl group forms a salt structure which is described later (—$COO^-Y^+$: wherein $Y^+$ represents alkali metal ions, alkaline earth metal ions, or organic cations, such as ammonium), the amount of carboxy groups can be determined by converting the salt to a carboxylic acid with acid, such as hydrochloric acid, and then titrating as described above.

More specifically, the amount of carboxyl groups in this exemplary embodiment refers to the amount of carboxyl groups including a carboxyl group which contributes to the salt structure, when the carboxyl group forms the salt structure.

—Process for Controlling a Particle Diameter—

The magnetic polymer particles granulated as described above are then further controlled with respect to the particle diameter in this process. Specifically, the above-mentioned desired particle diameter and particle size distribution are achieved by classification.

The classification can be performed by selection using, for example, a gravity classifier, a centrifugal separation classifier, an inertia classifier, or a sieving classifier. More specific examples of the classifier include various vibration sieves, an ultrasonic sieve, an air sieve, a wet sieve, a rotor classifier using the principle of centrifugal force, and an air classifier. However, the classifier is not limited to the above. These classifiers can be used singly or in combination of two or more to thereby achieve a desired particle size distribution. The wet sieve is preferable for precisely adjusting the particle size distribution.

—Process for Controlling the Amount of Magnetic Component—

Even when a desired particle diameter range and a desired particle size distribution are achieved by the process for controlling the particle diameter, the magnetic polymer particles have variations in the amount of magnetic particles contained in each magnetic polymer particle, and therefore have distribution of the content of magnetic particles for the particles overall. Therefore, the amount of magnetic components contained in each magnetic polymer particle is adjusted to a fixed range through this process. Moreover, in the magnetic polymer particles obtained in this exemplary embodiment, the number of the magnetic particles in one magnetic polymer particle may also be adjusted to a preferable range by undergoing this process.

The operation in this process is not limited. However, considering the fact that the magnetic polymer particle for developing a magnetic latent image of this exemplary embodiment is a particle having a relatively low magnetism, a method of removing particles containing a relatively large amount of magnetic particles from all of the obtained magnetic polymer particles by magnetic migration may be used.

Here, the separation using magnetic migration refers to a separation method which is performed by dispersing magnetic polymer particles containing magnetic particle(s) in a liquid, and adsorbing particles to a magnet having a fixed magnetism. For example, by immersing the magnet, while successively changing the magnetism, in a liquid in which certain magnetic polymer particles have been dispersed, and separating particles having a high magnetic force (i.e., a large amount of magnetic particles are contained) or particles not containing magnetic particles, the magnetic polymer particle for developing a magnetic latent image of this exemplary embodiment may be obtained as particles remaining in a final liquid.

As a device, a magnetic separator and a magnet catcher can be generally used, and, for example, a Magnet Separator MS-0 (manufactured by Noritake Co. Limited) can be used.

In this case, water may be used as a liquid in which the magnetic polymer particles are dispersed, and also the magnetism of a magnet drum may be adjusted to the range of from 0.1 T to 0.8 T.

The saturation magnetization per unit weight of the magnetic polymer particles for developing a magnetic latent image of this exemplary embodiment obtained through the above-described processes may be from about 3.6 emu/g to about 24.0 emu/g (or 3.6 emu/g to 24.0 emu/g).

When the saturation magnetization is in the above-mentioned range, the magnetic responsiveness particularly in a lower field may be improved, and a favorable responsiveness to the magnetic latent image may be achieved when the development is performed by a liquid magnetography method which is described later.

Specifically, the saturation magnetization can be determined by using a vibration sample magnetometer (VSM) (using, as a measuring device, a VSM-C7, manufactured by TOEI INDUSTRY CO., LTD.), obtaining an M-H curve, and dividing the magnetization at 10 kOe by the amount of a sample used for the measurement.

<Liquid Developer for Magnetic Latent Image>

A liquid developer for a magnetic latent image of this exemplary embodiment (hereinafter sometimes simply referred to as a "liquid developer") is a particle dispersion in which the magnetic polymer particle for developing a magnetic latent image of this exemplary embodiment has been dispersed as a toner in an aqueous medium, such as water.

The content of the magnetic polymer particle for developing a magnetic latent image may be in the range of about 1% by weight to about 20% by weight (or 1% by weight to 20% by weight) relative to the liquid developer.

As the aqueous medium, water or a substance in which a water-soluble organic solvent, such as methanol or ethanol, is added to water may be used. Among the above, use of water by itself is preferable. In the case of adding a water-soluble organic solvent, the addition amount thereof is, depending on the properties of the magnetic polymer particles to be dispersed, preferably 30% by weight or lower, and more preferably 10% by weight or lower based on the total amount of solvents.

In production of a liquid developer, various supplementary materials which can be used for an ordinary water-based particle dispersion can be used in combination. Examples thereof include a dispersant, an emulsifier, a surfactant, a stabilizing agent, a wetting agent, a thickener, a foaming agent, a defoaming agent, a coagulant, a gelling agent, an anti-settling agent, an electrification control agent, an anti-static agent, an anti-aging agent, a softener, a plasticizer, a filler, a colorant, an oderant, an antitack agent, and a release agent.

Specifically, as the above-mentioned surfactant, any known surfactants, such as anionic surfactants, nonionic surfactants, and cationic surfactants, are usable. Moreover, examples thereof include silicone surfactants, such as a polysiloxane oxyethylene adduct; fluorosurfactants, such as perfluoroalkyl carboxylate, perfluoroalkyl sulfonate, and oxyethylene perfluoro alkyl ether; and biosurfactants, such as spiculisporic acid, rhamnolipid, and lysolecithin.

As the dispersant, any polymers can be effectively used insofar as the polymer has a hydrophilic structure part and a hydrophobic structure part. Examples thereof include a styrene-styrene sulfonic acid copolymer, a styrene-maleic acid copolymer, a styrene-methacrylic acid copolymer, a styrene-acrylic acid copolymer, a vinylnaphthalene-maleic acid copolymer, a vinylnaphthalene-methacrylic acid copolymer, a vinylnaphthalene-acrylic acid copolymer, an alkyl acrylate-acrylic acid copolymer, an alkyl methacrylate-methacrylic acid copolymer, a styrene-alkyl methacrylate-methacrylic acid copolymer, a styrene-alkyl acrylate-acrylic acid copolymer, a styrene-phenyl methacrylate-methacrylic acid copolymer, and a styrene-cyclohexyl methacrylate-methacrylic acid copolymer. These copolymers may have any structures, such as those of a random copolymer, a block copolymer, and a graft copolymer.

Moreover, in this exemplary embodiment, for the purpose of controlling evaporativity or interfacial properties, a water-soluble organic solvent may be used. Examples of the water-soluble organic solvent include an organic solvent which is not divided into two phases when added to water, such as monohydric alcohols, polyhydric alcohols, a nitrogen-containing solvent, a sulfur-containing solvent, and other derivatives.

Furthermore, for the purpose of adjusting the electroconductivity, pH, etc., it is possible to add, to an aqueous medium, alkaline metal compounds, such as potassium hydroxide, sodium hydroxide, and lithium hydroxide; nitrogen-containing compounds, such as ammonium hydroxide, triethanolamine, diethanolamine, ethanolamine, and 2-amino-2-methyl-1-propanol; alkaline earth metal compounds, such as calcium hydroxide; acids, such as sulfuric acid, hydrochloric acid, and nitric acid; and salts of a strong acid and a weak alkali, such as ammonium sulfate.

In addition, for the purpose of mildewproofing, antiseptisizing, rust proofing, etc., benzoic acid, dichlorophen, hexachlorophene, sorbic acid, etc., may be added as required. Moreover, an antioxidant, a viscosity controlling agent, a conducting agent, a UV absorber, a chelating agent, etc., may be added.

When the magnetic polymer particle designed according to this exemplary embodiment described above is used as a magnetic toner in a liquid developer, an excellent dispersibility in an aqueous medium is exhibited. This is because magnetic particles hardly exist on the particle surfaces.

Therefore, when the above-mentioned liquid developer is used, there may be no variation in the micro surface tension in the liquid and, moreover, variation between particles in the mobility of the particles relative to the magnetic force at the time of development may be small. Therefore, the above-mentioned liquid developer may be effective for improving image qualities (concentration uniformity, thin line reproducibility, etc.) at the time of development.

The dispersibility in the aqueous medium can be evaluated by water dispersibility (dispersibility in pure water). More specifically, the dispersibility in the aqueous medium can be evaluated by putting the magnetic polymer particles in water with an amount of 20 times the weight of the polymer particles, and then observing the state of particles at the time of stirring the mixture. In this case, as a container containing the water, a glass container having an opening area of from about 1 $cm^2$ to about 10 $cm^2$ is used. In this evaluation, it is preferable that all of the magnetic polymer particles be favorably dispersed in the water without the magnetic polymer particles floating on the surface nor depositing on the container wall surface after stirring.

The production of the liquid developer for a magnetic latent image can be performed by the following procedure, but is not limited thereto.

First, a dispersion medium containing water as a main solvent and respective additives mentioned above is prepared using a magnetic stirrer or the like, and then the magnetic polymer particles are dispersed therein. Known methods are applicable to the dispersion. More specifically, a disperser, such as a ball mill, a sand mill, an attritor, and a roll mill, can be used. Moreover, a method in which dispersion is conducted by rotating a special stirring blade, such as a mixer, at a high speed; a method in which dispersion is conducted utilizing a shear force generated by a rotor starter, which is known as a homogenizer; and a method in which dispersion is conducted utilizing ultrasonic waves can be used.

It is confirmed by observing a separated dispersion liquid under a microscope that the magnetic polymer particles are independently dispersed in the liquid. Thereafter, an additive, such as an antiseptic agent, is added, and then it is confirmed that the additive is dissolved. Then, the obtained dispersion liquid is filtered using, for example, a membrane filter having a pore size of 100 μm to remove waste and coarse particles, thereby obtaining a liquid developer as a recording liquid for image formation.

The viscosity of the liquid developer in this exemplary embodiment may be, depending on an image forming system to be used, from 1 mPa·s to 500 mPa·s. When the viscosity of the liquid developer is less than 1 mPa·s, a sufficient image concentration may not be achieved because the amount of the magnetic polymer particles and the amount of the additive may not be sufficient. When the viscosity of the liquid developer is higher than 500 mPa·s, the handling may become difficult or the development properties may decrease due to excessively high viscosity.

<Cartridge, Image Forming Device>

Next, a process using the liquid developer for magnetic latent image containing the magnetic polymer particles of this exemplary embodiment will be described.

The image formation process to which the liquid developer of this exemplary embodiment is applied does not utilize an electrostatic latent image, such as a so-called electrophotography process, a process of forming an electrostatic latent image with ions and the like on a dielectric substance (ionography), and a process of forming an electrostatic latent image according to image information in a charged dielectric substance under heat of a thermal head. The image formation process to which the liquid developer of this exemplary embodiment is applied is a process of forming a magnetic latent image on an image carrying member to form a toner image (liquid magnetography). The structure is not limited except for using, as a developer, a liquid developer containing an aqueous medium.

Hereinafter, an image forming device employing the magnetic development process using the liquid developer for a magnetic latent image in this exemplary embodiment described above will be briefly described.

FIG. 1 is an outline block diagram illustrating an example of the image forming device of this exemplary embodiment employing the liquid magnetography method.

The image forming device 100 contains a magnetic drum (magnetic latent image carrying member) 10, a magnetic head (magnetic latent image forming unit) 12, a developing unit (developer storing portion and a developer supply portion) 14, an intermediate transfer body (transfer unit) 16, a cleaner 18, a demagnetizer (demagnetization unit) 20, and a transfer fixing roller (transfer unit) 28. The magnetic drum 10 has a cylindrical shape, and, on the outer circumference of the magnetic drum 10, the magnetic head 12, the developing unit 14, the intermediate transfer body 16, the cleaner 18, and the demagnetizer 20 are successively provided.

Hereinafter, the operation of this image forming device 100 will be briefly described.

First, the magnetic head 12 is connected to, for example, an information device (not illustrated), and receives binarized image data which has been sent from the information device. The magnetic head 12 forms a magnetic latent image 22 in the magnetic drum 10 by emitting magnetic lines of force while scanning the circumferential surface of the magnetic drum 10. It should be noted that, in FIG. 1, the magnetic latent image 22 is indicated by a crosshatched part in the magnetic drum 10.

The developing unit 14 contains a developing roller (a developer supply portion) 14*a* and a developer storage container (a developer storing portion) 14*b*. The developing roller 14*a* is provided in such a manner that the developing roller 14*a* is partially immersed in a liquid developer 24 stored in the developer storage container 14*b*.

It should be noted that the developing unit 14 equipped with the developing roller (the developer supply portion) 14*a* and the developer storage container (the developer storing portion) 14*b* is an example of a cartridge of this exemplary embodiment.

The liquid developer 24 contains an aqueous medium and toner particles. The toner particle is a magnetic toner (magnetic polymer particle) containing a magnetic material. The details of the aqueous medium and the toner particles are as described above.

In the liquid developer 24, the toner particles are uniformly dispersed. For example, by continuing to stir the liquid developer 24 at a given rotational rate with a stirring unit provided in the developer storage container 14*b*, variation in the concentration of the toner particles depending on positions in the liquid developer 24 may be reduced. Thus, the liquid developer 24 in which the variation in the concentration of the toner particles has been reduced is supplied to the developing roller 14*a* rotating in the direction indicated by the arrow A in FIG. 1.

The liquid developer 24 supplied to the developing roller 14*a* is conveyed toward the magnetic drum 10 in a state where the supply amount is limited to a fixed amount by a regulation component which is described later, and supplied to the magnetic latent image 22 at the position where the developing roller 14*a* and the magnetic drum 10 come close to each other (or contact). Thus, the magnetic latent image 22 is developed to form a toner image 26.

The toner image 26 developed as described above is conveyed on the rotating magnetic drum 10 in the direction indicated by the arrow B in FIG. 1, and transferred to a sheet (recording medium) 30. In this image forming device, a toner image is once transferred to an intermediate transfer body 16, so that the transfer efficiency to the recording medium including the separation efficiency of the toner image from the magnetic drum 10 can be improved before transferring the toner image 26 to the sheet 30, and moreover the transfer and fixation of the toner image 26 to the recording medium can be simultaneously performed.

Since the toner particles have almost no electrical charge, the transfer to the intermediate transfer body 16 may be performed by shearing transfer (non-electric field transfer). Specifically, the magnetic drum 10 rotating in the direction indicated by the arrow B and the intermediate transfer body 16 rotating in the direction indicated by the arrow C are brought into contact with each other with a given nip (contact surface having a contact width in the direction of movement), and then the toner image 26 is shifted to the intermediate transfer body by the adsorption power, which is higher than the magnetic force of the magnetic drum 10, to the toner image 26. At this time, a peripheral speed difference between the magnetic drum 10 and the intermediate transfer body 16 may be provided.

Subsequently, the toner image conveyed in the direction indicated by the arrow C by the intermediate transfer body 16 is transferred to the sheet 30 at a position in contact with a transfer fixing roller 28, and simultaneously fixed thereto.

The transfer fixing roller 28 sandwiches the sheet 30 with the intermediate transfer body 16, and fixes the toner image on the intermediate transfer body 16 to the sheet 30. Thus, the toner image is transferred to the sheet 30, and simultaneously, the toner image is fixed to the sheet to thereby form a fixed image 29. The toner image can be fixed by only applying pressure without heating because the liquid developer for a magnetic latent image of this exemplary embodiment is used as a developer. In this case, the pressure applied to the intermediate transfer body 16 by the transfer fixing roller 28 may be from 0.05 MPa to 10 MPa. Unlike this exemplary embodiment, when a fixation device is separately provided, the pressure applied to between the fixing rollers may be the same as above, for example.

In contrast, in the magnetic drum 10 after the toner image 26 has been transferred to the intermediate transfer body 16, residual toner on the magnetic drum is conveyed to a position in contact with a cleaner 18, and is collected by the cleaner 18. After cleaning, the magnetic drum 10 rotates to a demagnetization position while carrying the magnetic latent image 22.

A demagnetizer 20 eliminates the magnetic latent image 22 formed on the magnetic drum 10. The magnetic drum 10 is returned, by both the cleaner 18 and the demagnetizer 20, to the state before the image formation in which there is no variation in the magnetization state of the magnetic layer. By repeating the above operation, images sent one after another from the information device are formed successively in a short time. It should be noted that the magnetic head 12, the developing unit 14, the intermediate transfer body 16, the transfer fixing roller 28, the cleaner 18, and the demagnetizer 20 which are provided to the image forming device 100 are operated in synchronism with the rotational speed of the magnetic drum 10.

In the image forming device, as a magnetic latent image carrying member, the magnetic drum 10 that has water repellency may be used. The term water repellency as used herein refers to a property of repelling water, and specifically means that the contact angle with pure water is 70° or more.

It should be noted that the contact angle of the surface of the magnetic drum 10 is determined using a contact angle meter (CA-X, manufactured by Kyowa Interface Science Co., Ltd.) under the environment of a temperature of 25° C. and a relative humidity of 50% RH when 15 seconds have passed after 3.1 μl of pure water is added dropwise to the surface of the magnetic drum.

More specifically, an aqueous medium is used as a dispersion medium in the liquid developer. However, since water has a high surface tension due to hydrogen bonds, the liquid serving as the dispersion medium may be hard to transfer to the image carrying member, and a toner image may be transferred to a recording medium without leaving the liquid on the image carrying member by the combined use with a water-repellent image carrying member, even when the liquid developer is brought into contact with the image carrying member at the time of development. Therefore, a squeeze roller for removing residual solvent on the image carrying member or the like may not be required, and there may be almost no need to dry the recording medium to which the toner image has been transferred.

Furthermore, the aqueous medium having a high surface tension hardly wet-spreads on the surface of the image carrying member at the time of development. In contrast, the magnetic toner which is uniformly dispersed in the developer while having high mobility may transfer only to the magnetic latent image by the magnetic force when brought into contact with the image carrying member, and thus, a development environment in which image fogging hardly occurs may be formed.

When the liquid developer for a magnetic latent image of this exemplary embodiment in which the magnetic polymer particles each containing a specific magnetic particle(s) are uniformly dispersed is used, as a developer for image formation, for the image forming device employing the liquid magnetography method described above, a high quality image without reduction in brightness and chromaticness may be obtained, and moreover, contamination of a work environment due to a nonaqueous solvent may not occur.

EXAMPLES

Hereinafter, the present invention will be described in more detail with reference to Examples, but is not limited thereto. Unless otherwise specified, "parts" and "%" in the Examples means "parts by weight" and "% by weight", respectively.

Example 1

(Production of Magnetic Polymer Particles)

36 parts of n-butyl methacrylate (manufactured by Wako Pure Chemical Ind. Ltd.), 38 parts of styrene monomer (manufactured by Wako Pure Chemical Ind. Ltd.), and 11 parts of styrene acrylic-resin (S-LEC P-SE-0020, manufactured by Sekisui Chemical Co., Ltd.) are mixed. To the mixture, 7 parts of iron powder having an iron-oxide surface (manufactured by JFE, ultrafine iron powder having an average primary particle diameter of 0.8 μm), and 10 parts of cyan pigment (C.I. pigment blue 15:3, produced by Clariant Japan K.K.) are added, and then, dispersed in a ball mill for 24 hours. To 90 parts of the mixed solution containing the magnetic component, 5 parts of azobisisobutyronitril (manufactured by Wako Pure Chemical Ind. Ltd.) are added as a polymerization initiator, and a mixture containing a monomer, a magnetic particle, and a pigment is produced.

Separately, to an aqueous solution in which 28 parts of sodium chloride (manufactured by Wako Pure Chemical Ind. Ltd.) is dissolved in 160 parts of ion exchange water, 30 parts of calcium carbonate (LUMINUS, manufactured by Maruo Calcium Co., Ltd.) as a dispersion stabilizer and 3.5 parts of carboxymethylcellulose (CELLOGEN, manufactured by Dai-Ichi Kogyo Seiyaku Co., Ltd.) are added, and dispersed in a ball mill for 24 hours to be used as a dispersion medium.

The mixture produced above is put in the dispersion medium, and emulsified for 3 minutes at 8,000 rpm with an emulsifier (HIGH-FLEX HOMOGENIZER, manufactured by SMT Co., Ltd) to thereby obtain a suspension.

Nitrogen is introduced in a separable flask equipped with a stirrer, a thermometer, a condenser tube, and a nitrogen introducing tube through the nitrogen introducing tube to convert the atmosphere within the flask to a nitrogen atmosphere. The above-mentioned suspension is put therein, and reacted at 65° C. for 3 hours. The resultant is further heated at 70° C. for 10 hours, and then cooled. The reaction mixture is a favorable dispersion, and no aggregate is able to be visually observed during the polymerization.

A 10% aqueous hydrochloric acid solution is added to the reaction mixture to decompose the calcium carbonate, and solid-liquid separation is performed by centrifugal separation. The obtained particles are washed 3 times with 1 L of ion exchange water. Thereafter, using a magnetic separator MS-0 (manufactured by Noritake Co. Limited), particles not containing magnetic powder and particles excessively containing magnetic powder are removed at a process speed of 4.4 l/min. The obtained particles are dried under vacuum at 40° C. Then, coarse powder and fine powder are cut with an air classifier (elbow jet) to thereby obtain a magnetic polymer particle 1 having an average particle diameter of 5.0 μm.

(Analysis of Magnetic Polymer Particles)

—Number and Content of Magnetic Particle—

Figure 2B:
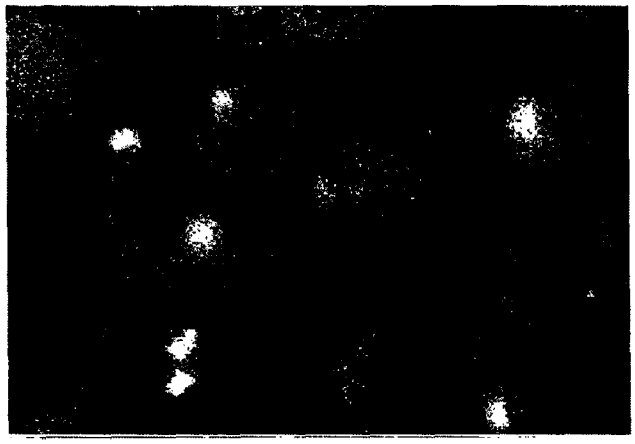
FIGS. 2A and 2B are a scanning micrograph and a reflection electron micrograph of magnetic polymer particles of the Examples of the present invention.
Figure 2A:
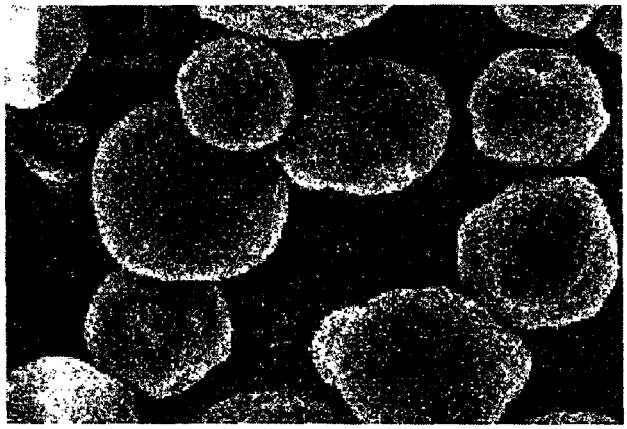

The magnetic polymer particles 1 are observed under a scanning electron microscope (SEM). FIG. 2A illustrates an observation photograph under ordinary conditions, and FIG. 2B illustrates an observation photograph of a reflection electron image, respectively. As illustrated in FIG. 2B, magnetic particles (parts which look white in the particles), which are not observed under ordinary observation conditions, in the magnetic polymer particles are confirmed by the reflection electron image. Eight magnetic polymer particles are observed for this, and the number of magnetic particles in each magnetic polymer particle is measured. As a result, the number of magnetic particles per magnetic polymer particle is measured to be two particles. Moreover, a polymer component having 10 mg of magnetic particles is dissolved using methyl ethyl ketone (manufactured by Wako Pure Chemical Ind. Ltd.), a photograph is created by observation under a scanning electron microscope (SEM), and then the particle diameter is measured. The number average particle diameter of the magnetic particles is 0.8 μm.

Further, the content of the magnetic particles in the magnetic polymer particles is calculated by thermal-analysis measurement to be 7.3% by weight.

—Saturation Magnetization—

The magnetic polymer particles 1 are measured for permeability according to the method described in JIS-C2531 (using, as a measuring device, VSM-C7 manufactured by TOEI INDUSTRY CO., LTD.). JIS-C2531 is incorporated herein by reference. The magnetization at 10 kOe is measured from the obtained M-H curve, and the saturation magnetization is calculated to be 15 emu/g.

(Production of a Liquid Developer for a Magnetic Latent Image)

Magnetic polymer particles 1: 5 parts

Polyoxyethylene (20) cetyl ether (manufactured by Wako Pure Chemical Ind. Ltd.): 0.5 parts Ion exchange water: 94.5 parts The above-mentioned respective components are mixed, and dispersed in a ball mill for 3 hours to thereby obtain a liquid developer 1 for magnetic latent images. In the production of the liquid developer, the particles neither float on the water surface nor deposit on a container wall surface, and all the particles are favorably re-dispersed in water. Thus, the dispersibility is excellent.

(Evaluation of System Properties)

With the structure illustrated in FIG. 1, an image forming device 100 using a magnetic drum of a commercially-available magnetographic printer (MG-8100 printer, manufactured by IWATSU ELECTRIC CO., LTD.) is prepared. Then, image evaluation is performed using the liquid developer 1 for magnetic latent images as a developer.

As a magnetic head 12, a full line type magnetic head having four channels capable of forming a pixel equivalent to 600 dpi composed of Mn—Zn ferrite is prepared.

As the developing unit 14, a developing device is used which is provided with, as a developing roller 14*a*, a magnet roll in which cylindrical permanent magnets are concentrically arranged in an aluminum nonmagnetic sleeve and a stirring blade for stirring a liquid developer within a developer storage container 14*b*. The liquid developer 1 for magnetic latent images is put in the developer storage container 14*b*, and then the developing unit 14 is arranged in such a manner that a gap between the surface of the nonmagnetic sleeve and the surface of the magnetic drum 10 is 50 μm.

As the intermediate transfer body 16, an aluminum intermediate transfer drum is used which has a 7.5 mm thick silicone rubber layer on the surface and rotates at the same peripheral speed as that of the magnetic drum 10. As the transfer fixing roller 28, an elastic roll is used in which the outer circumference of a stainless steel core material is covered with a silicone rubber layer and a fluororubber layer in this order.

Printing conditions are established as follows with the image forming device 100 structured as described above.

Magnetic drum linear velocity: 100 mm/sec

Ratio of developing-roller peripheral speed/magnetic drum peripheral speed: 1.2

Transfer conditions (intermediate transfer): Pressure applied to the magnetic drum by the intermediate transfer body being adjusted to 0.147 MPa (1.5 kgf/cm$^2$)

Transfer fixation conditions: Pressure of the transfer fixing roller applied to the intermediate transfer body being adjusted to 0.245 MPa (2.5 kgf/cm$^2$), and surface temperature being adjusted to 140° C.

Under the above-described conditions, magnetic latent images of a solid image and a thin line image are formed on the magnetic drum 10 by the magnetic head 12. Then, the liquid developer is brought into contact therewith by the developing roller, and development and transfer fixation are carried out. Separately, a liquid developer having the same composition except not containing the magnetic particles is produced, and then image formation is performed by the image forming device 100 in accordance with the above. Each image after transfer fixation is bright blue.

—Development Properties—

The solid image and the thin line image are visually observed, and evaluated according to the following evaluation criteria.

A: There is no unevenness in the solid image, and the thin line is sharp.

B: The thin line is sharp, but unevenness is observed in the solid image or irregularities are observed in the edge.

C: Unevenness is observed in the solid image or irregularities are observed in the edge, and the thin line is smeared and is not sharp.

D: Unevenness is observed in the solid image or irregularities are observed in the edge, and the thin line is broadened.

—Color Tone—

The color gamut of both the images after fixation are evaluated based on the color reproduction property measurement values (L*, a*, b*) and visually evaluated, respectively. Each numerical value of the above-mentioned L*, a*, and b* is measured with a spectrometer (938 Spectrodensitometer, manufactured by X-Rite). The ΔE (color difference) is calculated from the measurement results, and the color tone is evaluated according to the following criteria.

A: The ΔE is equal to or lower than 5.

B: The ΔE is higher than 5 and equal to or lower than 8.

C: The ΔE is higher than 8 and equal to or lower than 10.

D: The ΔE is higher than 10.

The ΔE (color difference) is calculated by: $\{(L_0^*-L_1^*)^2+(a_0^*-a_1^*)^2+(b_0^*-b_1^*)^2\}^{1/2}$. The $L_0^*$, $a_0^*$, and $b_0^*$ indicate the measurement values of liquid developer samples not containing magnetic particles, and the $L_1^*$, $a_1^*$, and $b_1^*$ indicate the measurement values of liquid developer samples containing magnetic particles.

The above results are illustrated in Table 1.

Example 2

A magnetic polymer particle 2 is produced in the same manner as in Example 1, except that the blending amount of the iron powder is changed to 4.5 parts, and 10 parts of magenta pigment (C.I. Pigment Red 57:1, manufactured by Clariant Japan K.K.) is used in place of the cyan pigment. The magnetic polymer particle 2 is similarly analyzed as in Example 1.

Subsequently, a liquid developer is produced in the same manner as in Example 1 except for using the magnetic polymer particle 2 in place of the magnetic polymer particle 1, and is similarly evaluated. The results are illustrated in Table 1 together with the analysis of the magnetic polymer particle.

Example 3

A magnetic polymer particle 3 is produced in the same manner as in Example 1, except that 10 parts of a material obtained by subjecting ultrafine iron powder (produced by JFE, average primary particle diameter: 0.8 μm) to decantation for removing fine powder in such a manner that the average primary particle diameter is 1.1 μm is used in place of the iron powder used in Example 1. The magnetic polymer particle 3 is similarly analyzed as in Example 1.

Subsequently, a liquid developer is produced in the same manner as in Example 1 except for using the magnetic polymer particle 3 in place of the magnetic polymer particle 1, and is similarly evaluated. The results are illustrated in Table 1 together with the analysis of the magnetic polymer particle.

Example 4

A magnetic polymer particle 4 is produced in the same manner as in Example 2, except that 6.0 parts of a material obtained by classifying carbonyl iron dust (manufactured by Basf Japan, HQ, average primary particle diameter: 1.0 μm) for removing coarse powder in such a manner that the average primary particle diameter is 0.3 μm is used in place of the iron powder. The magnetic polymer particle 4 is similarly analyzed as in Example 1.

Subsequently, a liquid developer is produced in the same manner as in Example 1 except for using the magnetic polymer particle 4 in place of the magnetic polymer particle 1, and is similarly evaluated. The results are illustrated in Table 1 together with the analysis of the magnetic polymer particle.

Example 5

A magnetic polymer particle 5 is produced in the same manner as in Example 1, except that 3.6 parts of a material obtained by classifying carbonyl iron dust (manufactured by Basf Japan, HQ, average primary particle diameter: 1.0 μm) for removing coarse powder in such a manner that the average primary particle diameter is 0.4 μm is used in place of the iron powder. The magnetic polymer particle 5 is similarly analyzed as in Example 1.

Subsequently, a liquid developer is produced in the same manner as in Example 1 except for using the magnetic polymer particle 5 in place of the magnetic polymer particle 1, and is similarly evaluated. The results are illustrated in Table 1 together with the analysis of the magnetic polymer particle.

Example 6

A magnetic polymer particle 6 is produced in the same manner as in Example 2, except that 2 parts of 0.5 μm grade ultrafine iron powder (manufactured by JFE, average primary particle diameter: 0.5 μm) is used in place of the iron powder used in Example 2. The magnetic polymer particle 6 is similarly analyzed as in Example 1.

Subsequently, a liquid developer is produced in the same manner as in Example 1 except for using the magnetic polymer particle 6 in place of the magnetic polymer particle 1, and is similarly evaluated. The results are illustrated in Table 1 together with the analysis of the magnetic polymer particle.

Example 7

A magnetic polymer particle 7 is produced in the same manner as in Example 2, except that 13 parts of a material obtained by removing fine powder of ultrafine iron powder (manufactured by JFE, average primary particle diameter of 0.8 μm) in such a manner that the average primary particle diameter is 1.1 μm is used in place of the iron powder used in Example 2. The magnetic polymer particle 7 is similarly analyzed as in Example 1.

Subsequently, a liquid developer is produced in the same manner as in Example 1 except for using the magnetic polymer particle 7 in place of the magnetic polymer particle 1, and is similarly evaluated. The results are illustrated in Table 1 together with the analysis of the magnetic polymer particle.

Comparative Example 1

A magnetic polymer particle 8 is produced in the same manner as in Example 1, except that 40 parts of magnetite (manufactured by Toda Kogyo Corp., average primary particle diameter: 0.1 μm) is used in place of the iron powder, and the removal of the particles with the magnetic separator after washing is not performed. The magnetic polymer particle 8 is similarly analyzed as in Example 1.

Subsequently, a liquid developer is produced in the same manner as in Example 1 except for using the magnetic polymer particle 8 in place of the magnetic polymer particle 1, and is similarly evaluated. The results are illustrated in Table 1 together with the analysis of the magnetic polymer particle.

Comparative Example 2

A magnetic polymer particle 9 is produced in the same manner as in Example 2, except that 5 parts of magnetite (manufactured by Toda Kogyo Corp., average primary particle diameter: 0.1 μm) is used in place of the iron powder, and the removal of the particles with the magnetic separator after washing is not performed. The magnetic polymer particle 9 is similarly analyzed as in Example 1.

Subsequently, a liquid developer is produced in the same manner as in Example 1 except for using the magnetic polymer particle 9 in place of the magnetic polymer particle 1, and is similarly evaluated. The results are illustrated in Table 1 together with the analysis of the magnetic polymer particle.

Comparative Example 3

A magnetic polymer particle 10 is produced in the same manner as in Example 1, except that 12 parts of a material obtained by separating coarse powder of ultrafine iron powder (manufactured by JFE, average primary particle diameter of 0.8 μm) in such a manner that the average primary particle diameter is 0.6 μm is used in place of the iron powder used in Example 1. The magnetic polymer particle 10 is similarly analyzed as in Example 1.

Subsequently, a liquid developer is produced in the same manner as in Example 1 except for using the magnetic polymer particle 10 in place of the magnetic polymer particle 1, and is similarly evaluated. The results are illustrated in Table 1 together with the analysis of the magnetic polymer particle.

Comparative Example 4

A magnetic polymer particle 11 is produced in the same manner as in Example 1 except that 15 parts of a material obtained by separating ultrafine iron powder (manufactured by JFE, Average primary particle diameter of 0.8 μm) with a mesh having a pore diameter of 1 μm in such a manner that the average primary particle diameter is 1.5 μm is used in place of the iron powder used in Example 1. The magnetic polymer particle 11 is similarly analyzed as in Example 1.

Subsequently, a liquid developer is produced in the same manner as in Example 1 except for using the magnetic polymer particle 11 in place of the magnetic polymer particle 1, and is similarly evaluated. The results are illustrated in Table 1 together with the analysis of the magnetic polymer particle.

TABLE 1

| | Pigment color | Number average particle diameter (μm) | Magnetic particle type | Number average particle diameter (μm) of magnetic particle | Number of magnetic particles | Amount of magnetic component (% by weight) | Saturation magnetization (emu/g) | System properties: Development properties | System properties: Color tone |
|---|---|---|---|---|---|---|---|---|---|
| Ex. 1 | Cyan | 5.0 | Iron | 0.8 | 3 | 7.3 | 15 | A | B |
| Ex. 2 | Magenta | 4.0 | Iron | 0.8 | 1 | 4.8 | 9.6 | A | B |
| Ex. 3 | Cyan | 6.5 | Iron | 1.1 | 3 | 9.8 | 21 | A | C |
| Ex. 4 | Magenta | 2.5 | Iron carbonyl | 0.3 | 2 | 2.1 | 4.2 | C | A |
| Ex. 5 | Cyan | 5.0 | Iron carbonyl | 0.4 | 10 | 6.0 | 12 | B | C |

TABLE 1-continued

| | Pigment color | Number average particle diameter (μm) | Magnetic particle type | Number average particle diameter (μm) of magnetic particle | Number of magnetic particles | Amount of magnetic component (% by weight) | Saturation magnetization (emu/g) | System properties: Development properties | System properties: Color tone |
|---|---|---|---|---|---|---|---|---|---|
| Ex. 6 | Magenta | 5.0 | Iron | 0.5 | 2 | 1.2 | 2.4 | C | A |
| Ex. 7 | Magenta | 5.0 | Iron | 1.1 | 2 | 12.0 | 22 | A | C |
| Comp. Ex. 1 | Cyan | 5.0 | Magnetite | 0.1 | 800 | 38 | 31 | B | D |
| Comp. Ex. 2 | Magenta | 4.0 | Magnetite | 0.1 | 100 | 4.8 | 4.0 | D | D |
| Comp. Ex. 3 | Cyan | 5.0 | Iron | 0.6 | 11 | 11.4 | 22 | A | D |
| Comp. Ex. 4 | Cyan | 5.0 | Iron | 1.5 | 1 | 16.2 | 24 | A | D |

Thus, in the Examples described above, since the magnetic polymer particles are used in which the particle diameters of the magnetic particles are large and the number of the magnetic particles is small, display and images excellent in development properties and exhibiting no reduction in brightness and chromaticness can be obtained. In contrast, in the Comparative Examples using a conventional magnetite or magnetic particle, whose particle diameter and content are not in a preferable range, problems arise in the color tone and the like.

What is claimed is:

1. A magnetic polymer particle for developing a magnetic latent image:

comprising a magnetic component, a polymer, and a colorant, the magnetic component being a magnetic particle containing an iron having a number average particle diameter of from about 0.2 μm to about 1.2 μm and the magnetic particle being contained in one magnetic polymer particle in an amount of from 1 to 10 particles, and the number average particle diameter of the magnetic polymer particle being from about 2.0 μm to about 7.0 μm, wherein the content of the magnetic component is from about 2% by weight to 12.0% by weight relative to the polymer particle.

2. The magnetic polymer particle for developing a magnetic latent image according to claim 1, wherein the saturation magnetization per unit weight of the magnetic polymer particle is from about 3.6 emu/g to about 24.0 emu/g.

3. A liquid developer for a magnetic latent image, comprising the magnetic polymer particle according to claim 1 and an aqueous medium.

4. The liquid developer according to claim 3, wherein the content of the magnetic component is from about 2% by weight to about 10% by weight relative to the polymer particle.

5. The liquid developer according to claim 3, wherein the saturation magnetization per unit weight of the magnetic polymer particle is from about 3.6 emu/g to about 24.0 emu/g.

6. The liquid developer for a magnetic latent image according to claim 3, wherein the content of the magnetic polymer particle for developing a magnetic latent image is in the range of from about 1% by weight to about 20% by weight relative to the liquid developer.

7. The liquid developer for a magnetic latent image according to claim 4, wherein the content of the magnetic polymer particle for developing a magnetic latent image is in the range of from about 1% by weight to about 20% by weight relative to the liquid developer.

8. The liquid developer for magnetic latent image according to claim 5, wherein the content of the magnetic polymer particle for developing a magnetic latent image is in the range of about 1% by weight to about 20% by weight relative to the liquid developer.

9. The magnetic polymer particle for developing a magnetic latent image according to claim 1, wherein the number average particle diameter of the magnetic particle containing the iron is from 0.5 μm to 0.8 μm.

10. The magnetic polymer particle for developing a magnetic latent image according to claim 1, wherein the number of the magnetic particles contained in one magnetic polymer particle is from 1 to 4 particles.

* * * * *